US009310708B2

(12) United States Patent
Maeda et al.

(10) Patent No.: US 9,310,708 B2
(45) Date of Patent: Apr. 12, 2016

(54) OPTICAL SCANNING DEVICE, IMAGE FORMING APPARATUS, AND OPTICAL SCANNING METHOD

(71) Applicants: Katsuhiko Maeda, Kanagawa (JP); Tadashi Shinohara, Kanagawa (JP); Yuugo Matsuura, Kanagawa (JP)

(72) Inventors: Katsuhiko Maeda, Kanagawa (JP); Tadashi Shinohara, Kanagawa (JP); Yuugo Matsuura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/334,995

(22) Filed: Jul. 18, 2014

(65) Prior Publication Data

US 2015/0054902 A1 Feb. 26, 2015

(30) Foreign Application Priority Data

Aug. 21, 2013 (JP) ..... 2013-171160

(51) Int. Cl.

| | |
|---|---|
| ***B41J 2/385*** | (2006.01) |
| ***B41J 2/47*** | (2006.01) |
| ***G03G 15/043*** | (2006.01) |
| *G03G 15/04* | (2006.01) |

(52) U.S. Cl.

CPC ..... *G03G 15/043* (2013.01); *G03G 15/04072* (2013.01)

(58) Field of Classification Search

CPC ..... G03G 15/04072; G03G 15/043

USPC ..... 347/229, 234, 235, 237, 247, 248–250, 347/252, 132, 144, 236, 239, 246, 255

See application file for complete search history.

(56) References Cited

U.S. PATENT DOCUMENTS

| | | | | |
|---|---|---|---|---|
| 5,742,323 | A * | 4/1998 | Fukushima | 347/246 |
| 6,137,518 | A | 10/2000 | Maeda | |
| 6,249,304 | B1 | 6/2001 | Sawayama et al. | |
| 6,292,206 | B1 | 9/2001 | Takehara et al. | |
| 6,483,529 | B1 * | 11/2002 | Ito et al. | 347/235 |
| 6,501,931 | B2 * | 12/2002 | Matsumoto | 399/167 |
| 6,963,615 | B2 * | 11/2005 | Kawasaki et al. | 375/240.26 |
| 7,313,352 | B2 | 12/2007 | Shinohara et al. | |
| 7,627,277 | B2 | 12/2009 | Maeda | |
| 7,940,422 | B2 | 5/2011 | Maeda | |
| 8,422,903 | B2 | 4/2013 | Maeda | |
| 2014/0072317 | A1 | 3/2014 | Shukuya et al. | |

FOREIGN PATENT DOCUMENTS

| | | | | |
|---|---|---|---|---|
| JP | 11105338 | A * | 4/1999 | B41J 2/44 |
| JP | 2000-118041 | | 4/2000 | |
| JP | 2003312050 | A * | 11/2003 | B41J 2/44 |
| JP | 2004-268436 | | 9/2004 | |

* cited by examiner

*Primary Examiner* — Hai C Pham

(74) *Attorney, Agent, or Firm* — Harness, Dickey & Pierce, P.L.C.

(57) ABSTRACT

An optical scanning device includes a light source emitting light to form an image by optical scanning; and a control section generating a control signal, which is for turning on and off the light source, based on an image signal. Further, the control section generates a pulse signal having a predetermined time width when the image signal indicates that the light source is to be turned off.

9 Claims, 13 Drawing Sheets

500

| TEMPERATURE ℃ T | CORRECTION COEFFICIENT WT |
|---|---|
| T≦15 | 1.4 |
| 15<T≦25 | 1.2 |
| 25<T≦35 | 1 |
| 35<T≦45 | 0.8 |
| 45<T | 0.6 |

501

| VOLT V | CORRECTION COEFFICIENT WV |
|---|---|
| T≦0.4 | 1.4 |
| 0.4<T≦0.8 | 1.2 |
| 0.8<T≦1.2 | 1 |
| 1.2<T≦1.6 | 0.8 |
| 1.6<T | 0.6 |

OPTICAL SCANNING DEVICE, IMAGE FORMING APPARATUS, AND OPTICAL SCANNING METHOD

CROSS-REFERENCE TO RELATED APPLICATIONS

The present application is based on and claims the benefit of priority under 35 U.S.C §119 of Japanese Patent Application No. 2013-171160 filed Aug. 21, 2013, the entire contents of which are hereby incorporated herein by reference.

BACKGROUND OF THE INVENTION

1. Field of the Invention

The present invention generally relates to an optical scanning device, an image forming apparatus, and an optical scanning method.

2. Description of the Related Art

In order to improve responsiveness of a light source in response to an instruction of a control signal (also known as and hereinafter simplified as "responsiveness"), there is a known method in which a weak current is kept flowing through the light source (also known as and hereinafter referred to as a "bias current") so that the light source emits weak light.

In this regard, in order to supply a stable gradation, there is a known method in which the bias current is controlled based on a light emission amount of the light source (see, for example, Japanese Laid-open Patent Publication No. 2004-268436).

Further, in order to reduce the temperature difference between the light sources, there is known a method in which the light source is emitted in a non-effective scanning period (see, for example, Japanese Laid-open Patent Publication No. 2000-118041).

SUMMARY OF THE INVENTION

According to an aspect of the present invention, an optical scanning device includes a light source emitting light to form an image by optical scanning; and a control section generating a control signal, which is for turning on and off the light source, based on an image signal. Further, the control section generates a pulse signal having a predetermined time width when the image signal indicates that the light source is to be turned off.

BRIEF DESCRIPTION OF THE DRAWINGS

Other objects, features, and advantages of the present invention will become more apparent from the following description when read in conjunction with the accompanying drawings, in which.

DETAILED DESCRIPTION OF THE PREFERRED EMBODIMENTS

In related technologies, to provide responsiveness to a light source, even when a bias current flows through the light source, as a light emission amount of the light source is decreased, a time period which is from when a current flows through the light source to when the light emits (also known as and hereinafter referred to as an "emission delay") is increased, thereby impairing the responsiveness.

Further, when the bias current is increased in order to improve the responsiveness, an image is formed while the light emission amount of the light source is increased, so that a phenomenon which is a so-called "scumming" (hereinafter referred to as "scumming") is more likely to occur.

According to an embodiment of the present invention, an object of the present invention is to improve the responsiveness of a light source, for example, in an optical scanning device.

In the following, embodiments of the present invention are described with reference to the accompanying drawings.

First Embodiment

Figure 1:
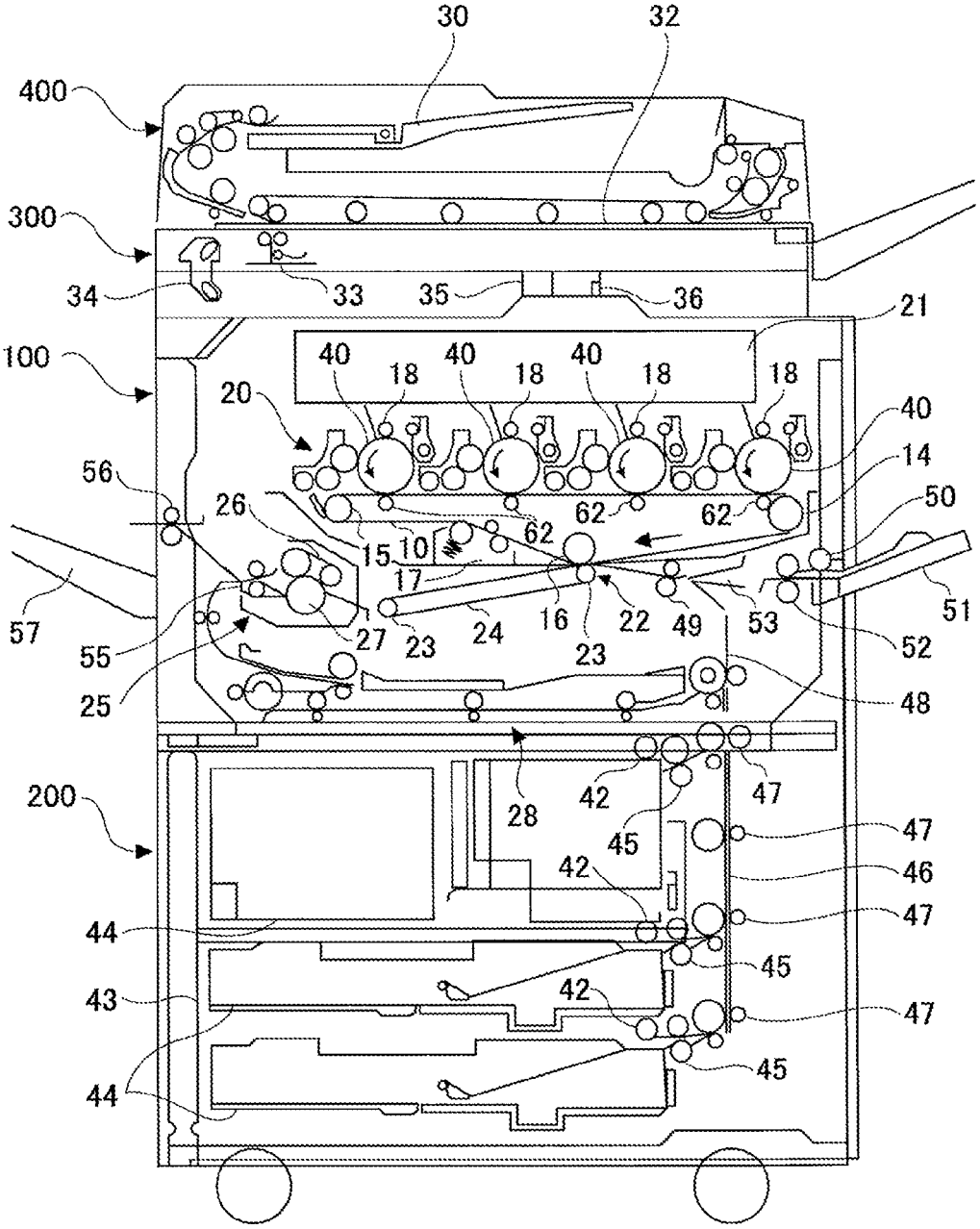
FIG. 1 illustrates an example of a schematic configuration of an image forming apparatus according to a first embodiment.

FIG. 1 illustrates an example of a schematic configuration of an image forming apparatus according to a first embodiment. The image forming apparatus in FIG. 1 forms a color image and employs an electrophotographic method using a secondary transfer mechanism called a tandem method.

The image forming apparatus 100 of FIG. 1 includes an intermediate transfer unit (not shown) having an endless intermediate transfer belt 10. The intermediate transfer belt 10 is stretched among three supporting rollers 14 through 16 and rotates in the clockwise direction.

An intermediate transfer body cleaning unit 17 removes residual toner on the intermediate transfer belt 10 after an imaging process which is described below.

Figure 2:
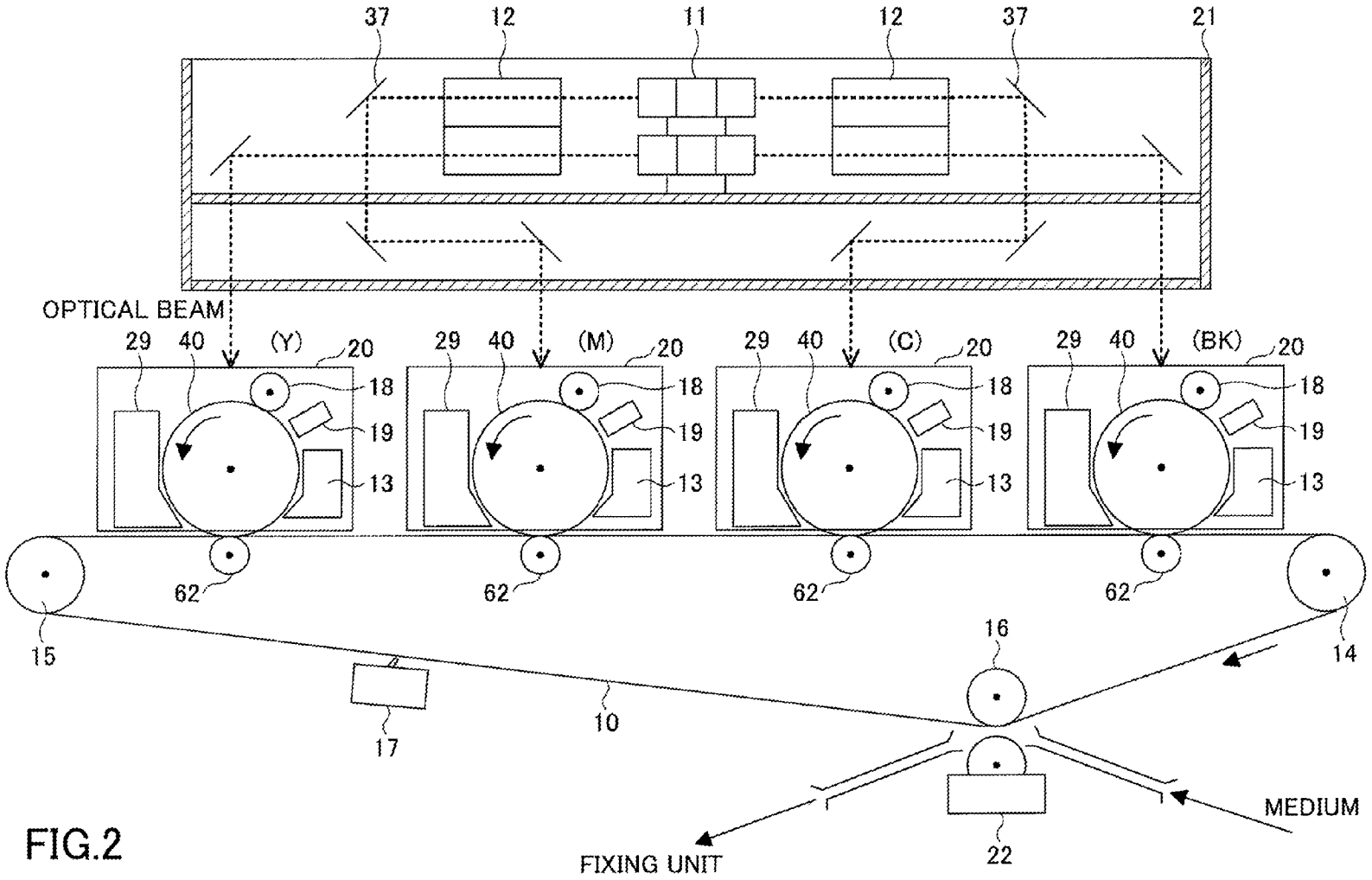
FIG. 2 illustrates an example of an image forming section according to the first embodiment.

Imaging devices 20 include, as illustrated in FIG. 2, respective cleaning units 13, charging units 18, discharging units 19, development units 29, and photosensitive body units 40, which are described below.

The image forming apparatus 100 includes separate imaging devices 20 corresponding to respective colors of, for example, yellow (Y), magenta (M), cyan (C), and black (BK). Hereinafter the colors may be simplified by using the symbols "Y", "M", "C", and "BK" respectively.

The imaging devices 20 are disposed between the first supporting roller 14 and the second supporting roller 15. The imaging devices 20 are arranged in the order of yellow (Y), magenta (M), cyan (C), and black (BK) imaging devices 20 in the feed direction of the intermediate transfer belt 10.

The imaging devices 20 are detachably mounted in the image forming apparatus 100.

An optical beam scanning device 21 irradiates laser light of the colors (i.e., Y, M, C, and BK) to form images on photosensitive drums of the respective photosensitive body units 40.

A secondary transfer unit 22 includes two rollers 23 and a secondary transfer belt 24.

The secondary transfer belt 24 is an endless belt stretched between the two rollers 23 and rotates. The rollers 23 and the secondary transfer belt 24 are provided so as to push up the intermediate transfer belt 10 to be pushed to contact the third roller 16.

The secondary transfer belt 24 transfers the image formed on the intermediate transfer belt 10 to a medium. The medium is a sheet paper, a plastic sheet or the like.

A fixing unit 25 performs a fixing process. The medium on which a toner image is formed is fed to the fixing unit 25. The fixing unit 25 includes a fixing belt 26 and a pressing roller 27. The fixing belt 26 is an endless belt. The fixing belt 26 and the pressing roller 27 are installed in such a manner that the fixing belt 26 pushes the pressing roller 27. The fixing unit 25 performs heating.

A sheet inversion unit 28 inverts the front and rear surfaces of the medium fed thereto. The sheet inversion unit 28 is used when an image is formed on the front surface and another image is to be formed on the rear surface.

An Auto Document Feeder (ADF) 400 feeds a medium onto a contact glass 32 when a start button on an operation unit (not shown) is pressed. When no medium exits on the contact glass 32, the ADF 400 causes an image reading unit 300 to read an image on the medium placed on the contact glass 32 by a user.

The image reading unit 300 includes a first carriage 33, a second carriage 34, an imaging lens 35, a Charged Coupled Device (CCD) 36, and a light source (not shown).

The image reading unit 300 operates the first carriage 33 and the second carriage 34 to read the image on the medium placed on the contact glass 32.

The light source of the first carriage 33 irradiates light onto the contact glass 32. The light from the light source of the first carriage 33 is reflected by the medium placed on the contact glass 32.

The reflected light is further reflected by a first mirror (not shown) and travels to the second carriage 34. The reflected light traveling to the second carriage 34 passes through the imaging lens 35 and forms an image on the CCD 36 which serves as a reading sensor.

The image forming apparatus 100 generates image data of each of the Y, M, C, and BK colors based on the information acquired by the CCD 36.

When the start button of the operation unit (not shown) is pressed, in response to an instruction to form an image from an external device (not shown) such as a Personal Computer (PC) or an instruction to output facsimile data, the image forming apparatus 100 starts rotating the intermediate transfer belt 10.

When the rotation of the intermediate transfer belt 10 is started, the imaging devices 20 start an image forming process. The medium onto which an image is transferred is fed to the fixing unit 25. The fixing unit 25 performs a fixing process, so that the image is fixed on the medium.

A sheet feeding table 200 includes sheet feeding rollers 42, a sheet feeding unit 43, separation rollers 45, and a feed roller unit 46. The sheet feeding unit 43 includes a plurality of sheet trays 44. The feed roller unit 46 includes feed rollers 47.

The sheet feeding table 200 selects one of the sheet feeding rollers 42. The sheet feeding table 200 rotates the selected sheet feeding rollers 42.

The sheet feeding unit 43 selects one of the sheet trays 44 and feeds media from the selected sheet tray 44. The fed media are separated by the separation roller 45 to be fed one by one into the feed roller unit 46.

The feed rollers 47 of the feed roller unit 46 feed the medium to the image forming apparatus 100.

The medium fed into the image forming apparatus 100 is further fed to a resist roller 49 by a feed roller unit 48. The medium fed to the resist roller 49 is in contact with and stopped by the resist roller 49. The medium is fed to the secondary transfer unit 22 when a toner image enters into the secondary transfer unit 22.

The medium may be fed from a manual tray 51. When the medium is fed from the manual tray 51, the image forming apparatus 100 rotates a feed roller 50.

The feed roller 50 separates plural media on the manual tray 51 one at a time into a single medium. The feed roller 50 feeds the separated medium to a sheet feeding path 53. The medium fed to the sheet feeding path 53 is further fed to the resist roller 49. The process after the medium is fed to the resist roller 49 is the same as that when a medium is fed from the sheet feeding table 200.

An image formed on the medium is fixed by the fixing unit 25 and then discharged therefrom. The medium discharged from the fixing unit 25 is fed to a discharge roller 56 by a selector claw 55. The discharge roller 56 feeds the fed medium to a discharge tray 57.

Further, the selector claw 55 may feed the medium, which is discharged from the fixing unit 25, to the sheet inversion unit 28. The sheet inversion unit 28 inverts the front and rear surfaces of the medium fed thereto. An image is formed on the rear surface of the inverted medium similar to the front surface thereof. Then, the medium is fed to the discharge tray 57.

On the other hand, toner remaining on the intermediate transfer belt 10 is removed by the intermediate transfer body cleaning unit 17. After the toner remaining on the intermediate transfer belt 10 is removed, the image forming apparatus 100 is prepared for another image forming process.

Image forming section

FIG. 2 illustrates an example of an image forming section according to the first embodiment.

An image forming section 3 includes the intermediate transfer belt 10, the imaging devices 20 corresponding to the colors, the optical beam scanning device 21 described below, the intermediate transfer body cleaning unit 17, and the secondary transfer unit 22.

Optical beams from the optical beam scanning device 21 described below are incident into the imaging devices 20.

The imaging devices 20 perform the respective imaging processes. An image forming process of an electrophotographic picture includes five processes of charging, exposing, developing, transferring, and fixing. The image forming process includes processes of charging, exposing, developing, and transferring.

In the image forming process, the imaging device 20 forms toner images of the colors on the intermediate transfer belt 10. A four-color toner image is formed by sequentially superimposing color toner images formed by the imaging devices 20 for the respective colors.

Optical beams modulated based on the image data are incident onto the respective photosensitive body units 40 of the imaging devices 20.

The charging unit 18 performs a charging process. In the charging process, a surface of the photosensitive body unit 40 is charged by the charging unit 18.

The exposing process by optical beams is performed on the charged photosensitive body unit 40. In the exposing process, an electrostatic latent image is formed on the surface of the photosensitive body unit 40.

The development unit 29 performs the developing process. In the developing process, toner is adhered to the electrostatic latent image formed on the photosensitive body unit 40 so as to form a toner image. Toner is supplied from a toner bottle (not shown) to the development unit 29.

The toner image is transferred onto the intermediate transfer belt 10 by a transfer unit 62.

The imaged (formed) toner images of the colors are superimposed on the intermediate transfer belt 10 to be transferred as a single toner image.

After the transferring, the discharging unit 19 discharges the photosensitive body unit 40, and the cleaning unit 13 removes the toner image.

Upon the transferred toner image entering into the secondary transfer unit 22, the medium is fed to the secondary transfer unit 22, so that the toner image on the intermediate transfer belt 10 is transferred onto the medium fed to the secondary transfer unit 22.

The secondary transfer unit 22 transfers the four-color toner image formed on the intermediate transfer belt 10 onto the medium. After that, the fixing unit 25 performs the fixing process.

After the transferring process, the intermediate transfer body cleaning unit 17 removes the four-color toner image.

Optical beam scanning device

Figure 3:
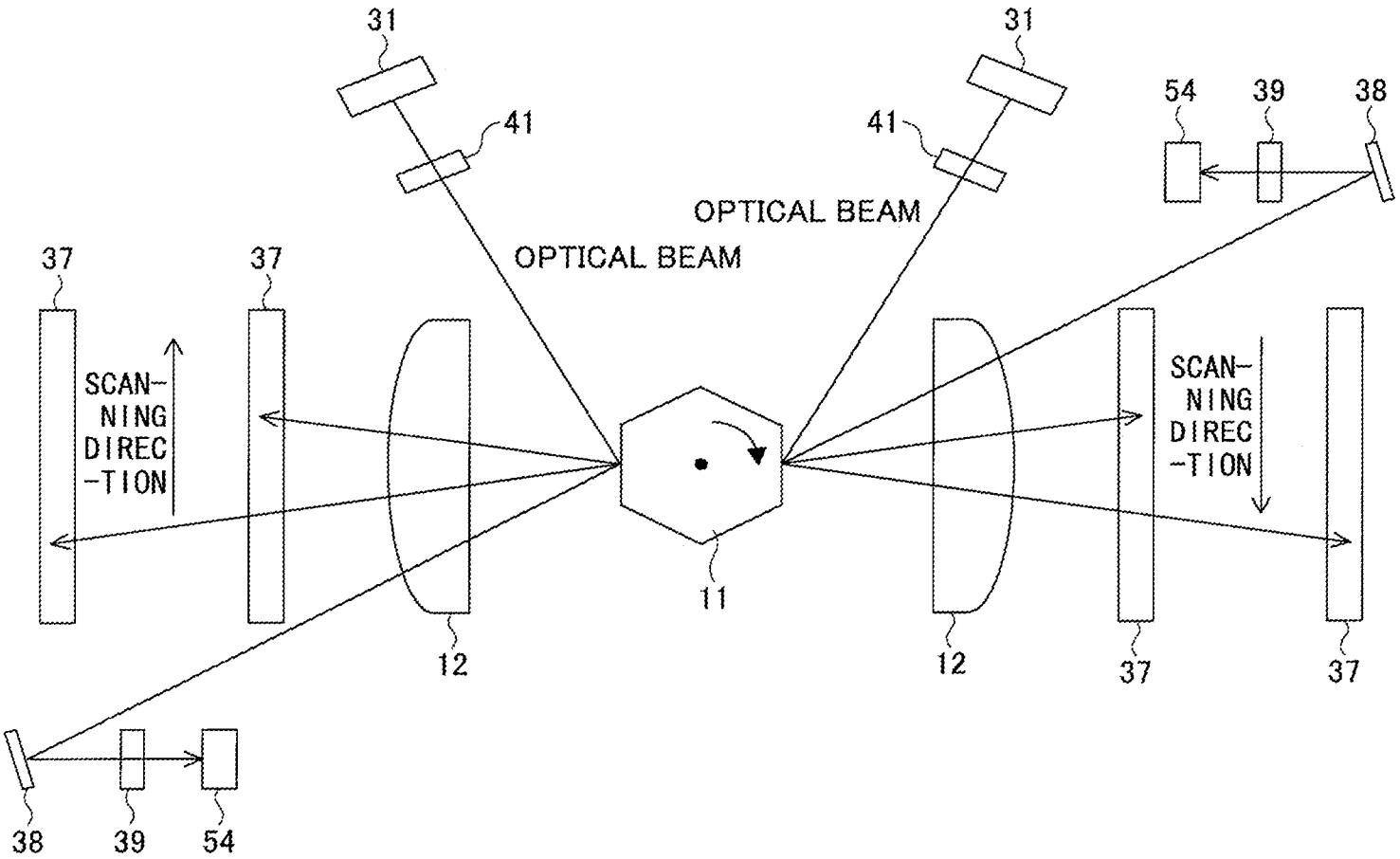
FIG. 3 illustrates an example of an optical beam scanning device according to the first embodiment.

FIG. 3 illustrates an example of an optical beam scanning device according to the first embodiment. FIG. 3 is a top view of the optical beam scanning device 21.

The optical beam scanning device 21 is an example of an optical scanning device. The optical beam scanning device 21 includes a polygon mirror 11, an fθ lens 12, a Laser Diode (LD) control board 31, a folding mirror 37, and a synchronization mirror 38. The optical beam scanning device 21 further includes a synchronization lens 39, a cylinder lens 41, and a synchronization sensor 54.

In the optical beam scanning device 21 as exemplarily illustrated in FIG. 3, a single LD control board 31 includes a light source(s) to write two-color images.

The LD control board 31 includes the light source(s) to emit optical beams. The optical beams are controlled to be driven and modulated by a control section 212. The light source(s) of the LD control board 31 is controlled based on input imaged data. The light (light beam) emitted from the LD control board 31 travels through the cylinder lens 41 and is reflected by the polygon mirror 11. The polygon mirror 11 is rotated by a motor (not shown) and reflects the incident light.

The polygon mirror 11 reflects optical beams at the upper and lower parts thereof in a manner that a color of one optical beam reflected at the upper part differs from a color of the other optical beam reflected at the lower part.

One LD control board 31 is disposed at the upper part and the other LD control board 31 is disposed at the lower part. The light emitted from the LD control board 31 at the upper part is reflected by the polygon mirror 11 at the upper part of the polygon mirror 11, and the light emitted from the LD control board 31 at the lower part is reflected by the polygon mirror 11 at the lower part of the polygon mirror 11.

The polygon mirror 11 directs the incident light beams to the corresponding (desired) directions. By doing this, it becomes possible to direct the four color optical beams to the respective photosensitive body units 40 corresponding to the colors.

The light beams reflected by the polygon mirror 11 pass through the fθ lens 12 and direct to the folding mirror 37. The light beams reflected by the folding mirror 37 are incident into the respective imaging devices 20.

The light beam having passed through the fθ lens 12 is reflected by the synchronization mirror 38 and then passes through the synchronization lens 39 to be incident into the synchronization sensor 54. The synchronization sensor 54 detects a start timing of writing in the main scanning direction based on the incident light beam.

Figure 4:
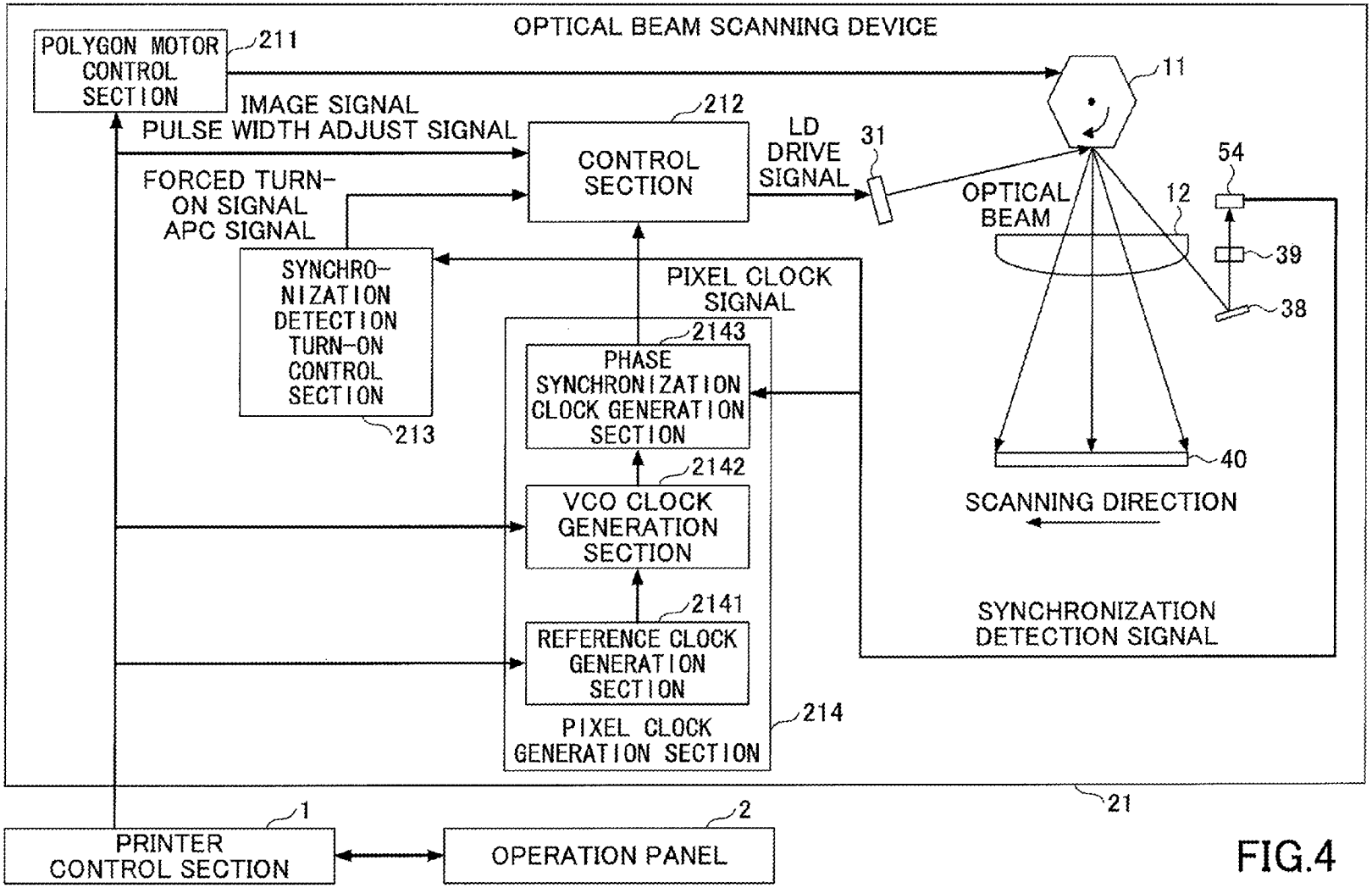
FIG. 4 is an example functional block diagram of the optical beam scanning device according to the first embodiment.

FIG. 4 is an example functional block diagram of the optical beam scanning device according to the first embodiment. More specifically, FIG. 4 is an example functional block diagram of the light beam scanning device of one color.

The optical beam scanning device 21 includes a polygon motor control section 211, a control section 212, a synchronization detection turn-on control section 213, and a pixel clock generation section 214. The optical beam scanning device 21 is connected to a printer control section 1.

The polygon motor control section 211 performs control to rotate a polygon motor (not shown) at a predetermined rotation speed (rpm) in accordance with an instruction from the printer control section 1. A user inputs various directions by key operations on an operation panel 2. The printer control section 1 outputs the instructions to the polygon motor control section 211 based on the inputs from the operation panel 2.

The control section 212 controls the LD control board 31 based on a forced turn-on signal, an automatic power control (APC) signal, a pixel clock signal, and an image signal. The control section 212 applies an LD drive signal to the LD control board 31 to turn on and off the light sources.

The light (light beam) emitted from the LD control board 31 is incident into the polygon mirror 11. The control section 212 includes a pulse width modulation (PWM) signal generation section 2121 and an LD drive section 2122 which are described in detail below.

The synchronization detection turn-on control section 213 generates the APC signal based on the pixel clock signal and a synchronization detection signal. The synchronization detection turn-on control section 213 sends the generated APC signal to the control section 212.

The synchronization detection turn-on control section 213 sets the forced turn-on signal to "ON" at a timing which is described in detail below. When the forced turn-on signal is set to "ON", light is emitted from the LD control board 31. The light emitted from the LD control board 31 is detected by the synchronization sensor 54. Upon detecting the light, the synchronization sensor 54 outputs the synchronization detection signal.

Figure 5:
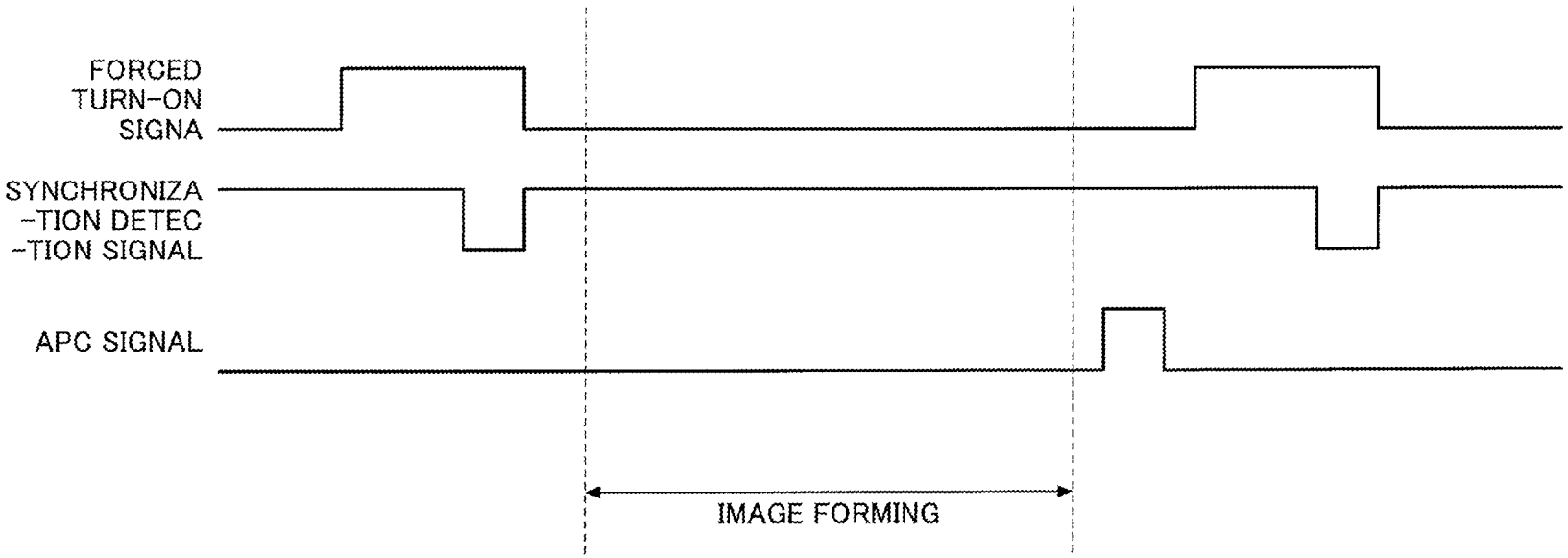
FIG. 5 is an example timing chart illustrating a turn-on timing of a Laser Diode (LD) according to the first embodiment.

FIG. 5 is an example timing chart illustrating a turn-on timing of a Laser Diode (LD) according to the first embodiment.

As illustrated in FIG. 5, the APC signal is set to "ON" at the timing other than the timing when an image is formed, details of which are described below. Namely, in a process of the APC, the LD is turned ON. Therefore, the process of the APC is executed at a timing when an image is not formed.

Further, as illustrated in FIG. 5, the forced turn-on signal is turned ON at a timing when an image is not formed and the process of the APC is not executed.

The synchronization detection turn-on control section 213 sends the APC signal and the forced turn-on signal to the control section 212 at the timings as illustrated in FIG. 5.

Here, it should be noted that the timings when the APC signal and the forced turn-on signal to the control section 212 are to be set ON are riot limited to the timings as illustrated in FIG. 5. For example, in a case where there are a plurality of light sources and there is one Photo Diode (PD) to measure the amount of light (light intensity), it is desired to execute the process of the APC for each of the light sources. Therefore, the APC signal may be turned ON in accordance with the number of the light sources.

Further, the synchronization detection signal is detected by setting the forced turn-on signal to ON at the timing when no flare light occurs based on the synchronization detection signal, which is previously output, and the pixel clock signal.

The pixel clock generation section 214 includes a reference clock generation section 2141, a Voltage Controlled Oscillator (VCO) clock generation section 2142, and a phase synchronization clock generation section 2143.

The reference clock generation section 2141 generates a reference clock signal.

The VCO clock generation section 2142 generates a VCO clock signal.

Figure 6:
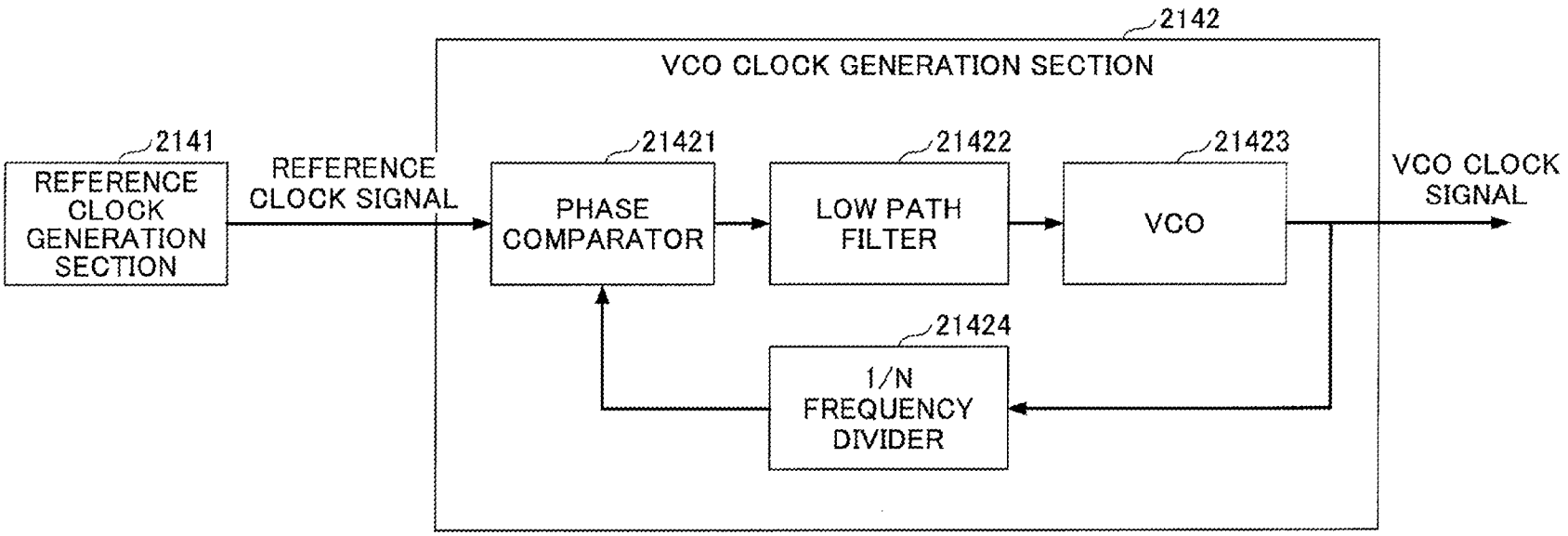
FIG. 6 is a functional block diagram of an example of a Voltage Control Oscillator (VCO) clock generation section according to the first embodiment.

FIG. 6 is a functional block diagram of an example of the VCO clock generation section 2142 according to the first embodiment. The VCO clock generation section 2142 includes a phase comparator 21421, a low path filter 21422, a VCO 21423, and a 1/N frequency divider 21424.

The phase comparator 21421 inputs (receives) the reference clock signal from the reference clock generation section 2141 and the clock signal from the 1/N frequency divider 21424, the clock signal having been divided by N by the 1/N frequency divider 21424. The phase comparator 21421 compares the phases of the falling-down edges between the input two signals and outputs the error component as a predetermined current.

The low path filter 21422 removes the hi frequency component from the output of the phase comparator 21421 and outputs the direct-current DC voltage.

The VCO 21423 outputs the VCO clock signal having (representing) a predetermined frequency based on the output from the low path filter 21422.

The 1/N frequency divider 21424 divides the input (received) VCO clock signal by N based on a set division ratio N.

Here, it is possible for the printer control section 1 to set the frequency of the reference clock signal and the division ratio N. The pixel clock generation section 214 can change the frequency of the VCO clock signal by changing the frequency of the reference clock signal and the value of the division ratio N.

The phase synchronization clock generation section 2143 inputs (receives) the VCO clock signal from the VCO clock generation section 2142 and the synchronization detection signal. The phase synchronization clock generation section 2143 outputs the pixel clock signal, which is in synchronization with the synchronization detection signal, to the control section 212. The frequency of the pixel clock signal is changed based on the frequency of the VCO clock signal.

Control Section

Figure 7:
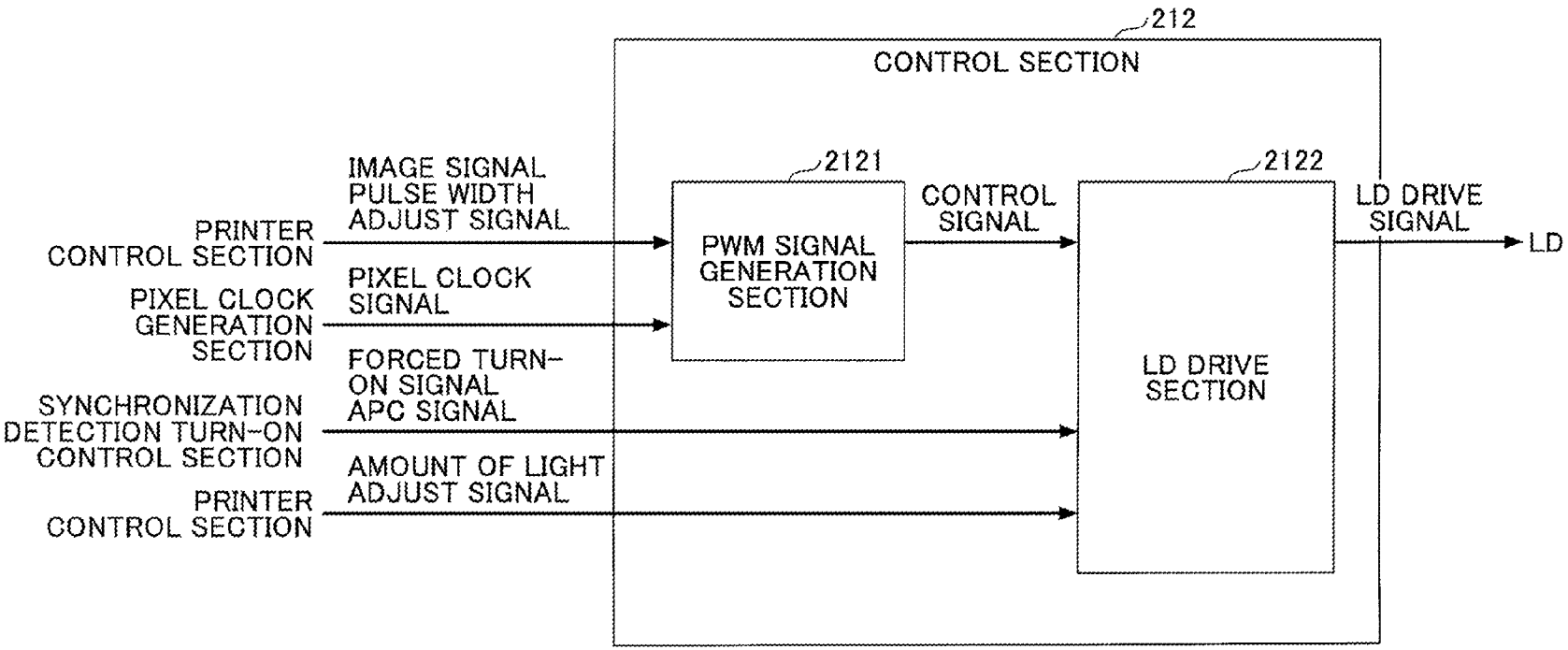
FIG. 7 is a functional block diagram of an example of a control section according to the first embodiment.

FIG. 7 is a functional block diagram of an example of the control section 212 according to the first embodiment.

The control section 212 controls the light-emitting time of the light source LD based on a duty ratio of the pulse signal of a control signal. That is, the control section 212 performs the so-called "PWM control" (hereinafter referred to as also "PWM control"). By the control based on the duty ratio, the control section 212 controls the density of an image.

The PWM signal generation section 2121 generates a control signal based on the input (received) image signal. The PWM signal generation section 2121 generates a pulse signal, which is described in detail below, in response to the image signal.

The PWM signal generation section 2121 inputs (receives) the image signal and a pulse width adjust signal which are input from the printer control section 1. The PWM signal generation section 2121 further inputs (receives) the pixel clock signal from the pixel clock generation section 214.

Here, the pulse width of the control signal can be determined by an operator by using the pulse width adjust signal. Further, the control signal is not limited to the PWM signal.

The LD drive section 2122 performs control to turn on and off the light sources LD of the LD control board 31 based on the input (received) control signal, the forced turn-on signal, and the APC signal. The LD drive section 2122 turns on the light source LD for the process of APC at the timings based on the input (received) APC signal.

Further, the LD drive section 2122 turns on the light source LD at the timings based on the input (received) forced turn-on signal. The LD drive section 2122 can adjust an amount of the light of the light sources of the LD control board 31 based on an amount of light adjust signal.

The LD drive section 2122 controls an emitting time period of the light source LD by a LD drive control signal based on the time width of the pulse of the control signal.

Figure 8:
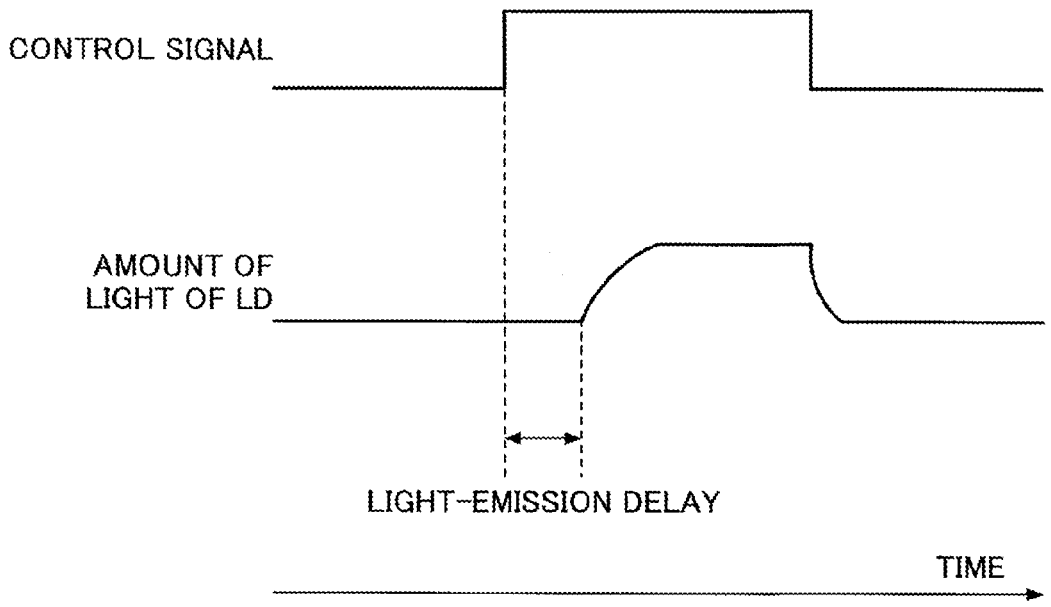
FIG. 8 illustrates an example operation of a light source according to the first embodiment.

FIG. 8 illustrates an example operation of the light source LD according to the first embodiment.

When the PWM signal generation section 2121 applies the control signal to the light source LD to turn on the light source LD, the light source LD emits light based on the input (received) control signal.

As illustrated in FIG. 8, in the light emission of the light source LD, a light-emission delay occurs having a time period from when the control signal to turn on the light source is applied to when the light source generates light (starts emitting). In this regard, if a control signal having a time width shorter than the light-emission delay is applied, a current flows in the light source LD but the light source LD does not emit light.

Control Signal

Figure 9:
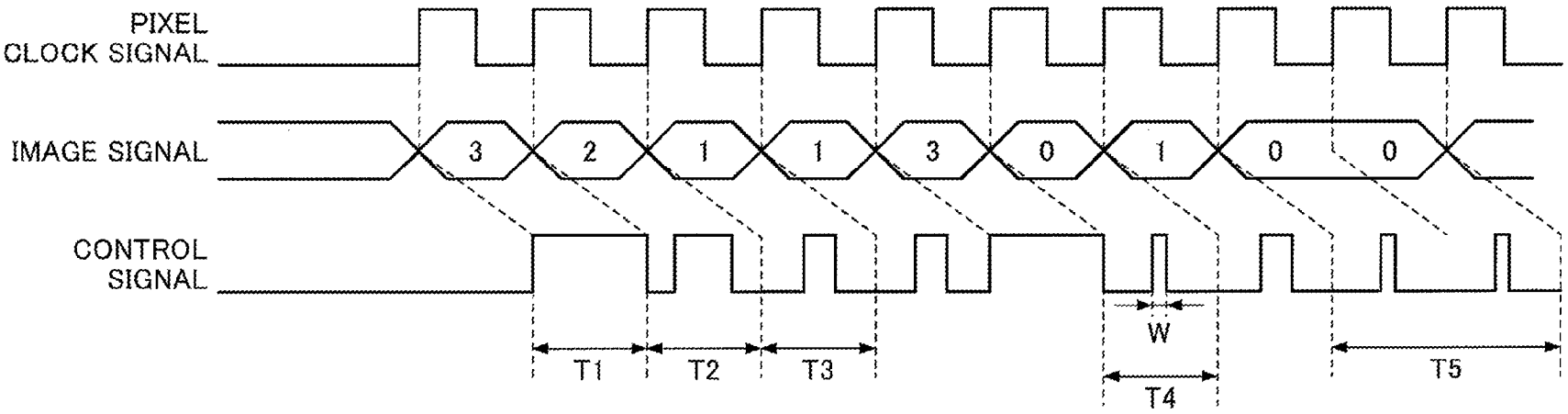
FIG. 9 is an example timing chart illustrating a timing of a control signal according to the first embodiment.

FIG. 9 is an example timing chart illustrating a timing of the control signal according to the first embodiment.

As illustrated in FIG. 9, the control signal is a pulse signal having a predetermined time width to be output relative to the input (received) image signal.

FIG. 9 illustrates a case where the image signal has two bits, so that the value of the image signal indicates any of 0, 1, 2, and 3. For example, when the value of the image signal is 3, the duty ratio of the control signal is 100% as indicated as "T1" in FIG. 9. Similarly, when the values of the image signal are 2 and 1, the duty ratios of the control signal are 66% and 33%, respectively. When the value of the image signal is 0, the image signal turns off the light source LD. To that end, when the value of the image signal is 0, the PWM signal generation section 2121 generates the control signal having a time width "W" which is shorter than the light-emission delay as indicated as "T4" in FIG. 9.

By generating the control signal having the time width "W" shorter than the light-emission delay when the value of the image signal is 0, it becomes possible to improve the responsiveness of the light source LD in response to the next turning on (light emission) of the light source LD. For example, as illustrated in T5 of FIG. 9, in a case where the value "0" of the image signal continues, if the control signal having a shorter time width is generated in series, the light source LD does not turn on, thereby preventing the occurrence of scumming.

In this case where the value "0" of the image signal continues, (only) the control signal, which is right before the value of the image signal becomes more than "0", may have a time width shorter than the light-emission delay.

Here, it should be noted that the bit width of the image signal is not limited to two bits. For example, the bit width of the image signal may be one bit, so that the value of the image signal is 0 or 1. Also, the bit width of the image signal may be more than two bits.

Further, the duty ratios of the control signal are not limited to 100%, 66%, and 33%. For example, the duty ratio of the control signal relative to the image signal may be set based on the pulse width adjust signal which is input from the printer control section 1.

Overall Process

Figure 10:
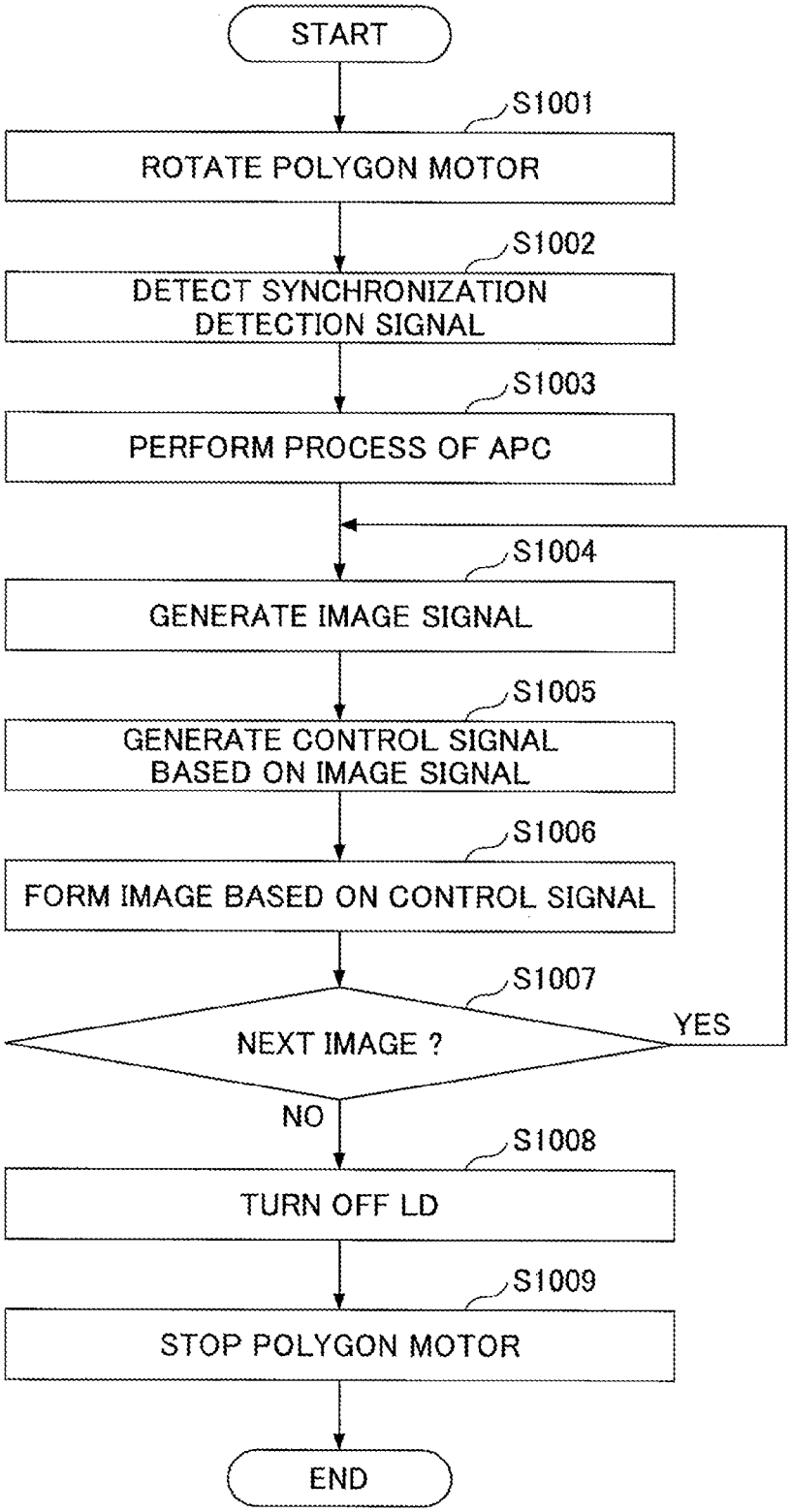
FIG. 10 is an example flowchart of overall process of a light scanning device according to an embodiment.

FIG. 10 is an example flowchart of overall process of the light scanning device according to an embodiment.

In step S1001, when the start button on the operation panel 2 is pressed, the optical beam scanning device 21 rotates the polygon motor (not shown) at the predetermined rotation speed (rpm).

In step S1002, the optical beam scanning device 21 sets the forced turn-on signal to ON and detects the synchronization detection signal.

In step S1003, the optical beam scanning device 21 sets the APC signal to ON and starts the process of the APC which is described above with reference to FIG. 5.

In step S1004, the printer control section 1 generates the image signal based on the data of the image to be formed and sends the image signal to the control section 212.

In step S1005, the control section 212 generates the control signal to be used to turn on and off the light source LD based on the image signal, the control signal being described with reference to FIG. 9.

In step S1006, the light source LD turns on and off based on the control signal to form an image.

In step S1007, the optical beam scanning device 21 determines whether there is the next image to be processed. When the optical beam scanning device 21 determines that there is the next image to be processed (YES in step S1007), the process goes back to step S1004, so that the optical beam scanning device 21 starts the process for the next image. When the optical beam scanning device 21 determines that there is no next image to be processed (NO in step S1007), the process goes to step S1008.

In step S1008, the optical beam scanning device 21 turns off the light source LD.

In step S1009, the optical beam scanning device 21 stops the polygon motor (not shown) and terminates the process.

Second Embodiment

In a second embodiment, the optical beam scanning device 21 of FIG. 4 is used. Therefore, the repeated descriptions are herein omitted.

The second embodiment differs from the first embodiment in the case where when the value of the image signal as illustrated in FIG. 9 in the first embodiment is 0, the PWM signal generation section 2121 generates the control signal having a time width shorter than the light-emission delay.

Figure 11:
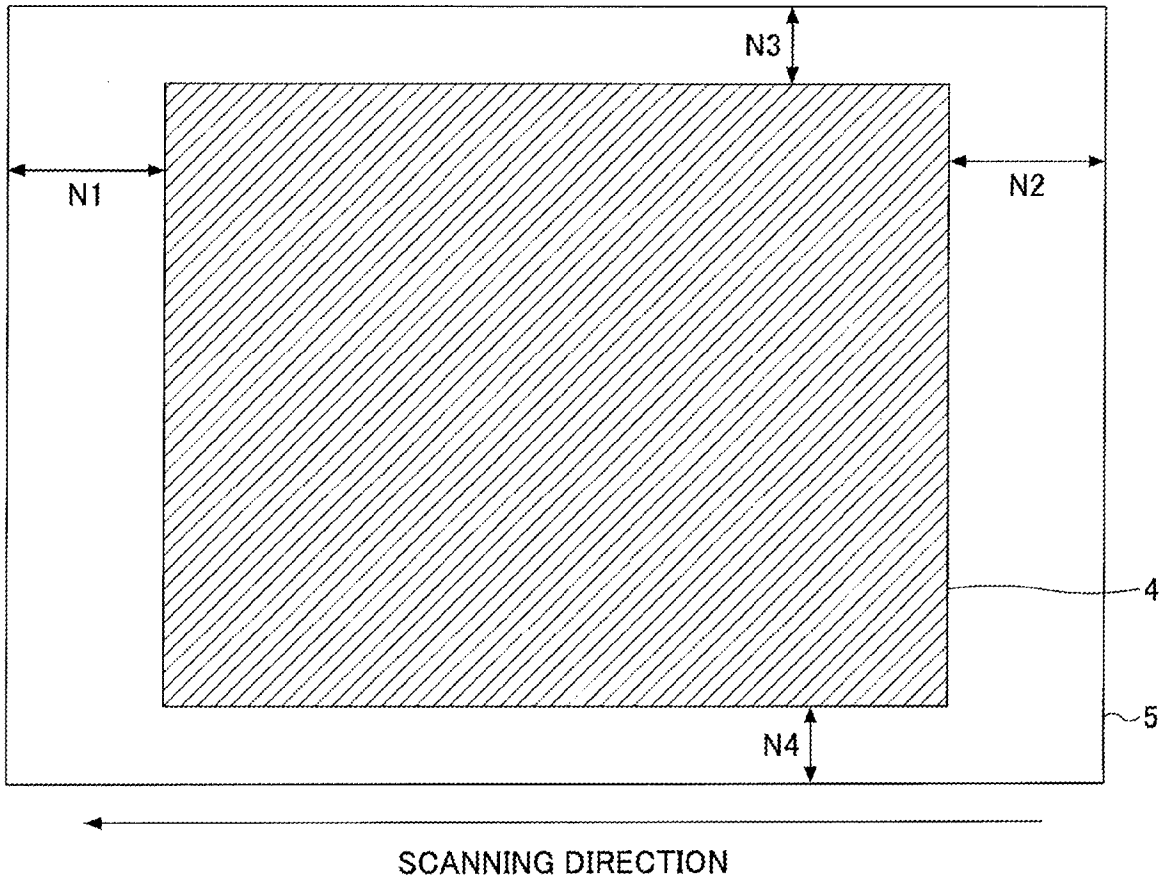
FIG. 11 illustrates an example area where a pulse signal is generated according to a second embodiment.

FIG. 11 illustrates an example of an area where a pulse signal is generated according to the second embodiment.

FIG. 11 exemplarily illustrates a case where a range in which the optical beam scanning device 21 scans is set to a scanning area 5.

An image forming area 4 in FIG. 11 refers to an area where an image is formed by optical scanning. For example, in a case of a copier or a multifunction peripheral, the image forming area 4 refers to an area in which an image of a character, a pattern, a figure, etc., is to be formed.

In this embodiment, in an area other than the image forming area 4, the generation of the control signal having a time width shorter than the light-emission delay is controlled (prevented). Namely, in an area N1, N2, N3, or N4, the optical beam scanning device 21 controls (prevents) the generation of the control signal that has a time width shorter than the light-emission delay.

By controlling (preventing) the emission of the light source LD in an area N1, N2, N3, or N4 by the optical beam scanning device 21, it becomes possible to extend the usable time period (the so-called service life time span) of the light source LD. Also, by controlling (preventing) the emission of the light source LD in an area N1, N2, N3, or N4, it becomes possible to reduce the energy consumption of the optical beam scanning device 21.

Third Embodiment

In a third embodiment, the optical beam scanning device 21 of FIG. 4 is used. Therefore, the repeated descriptions are herein omitted.

In the third embodiment, when the value of the image signal, which is described in the first embodiment with reference to FIG. 9, is 0, the time width of the control signal generated by the PWM signal generation section 2121 is determined based on a temperature or the voltage of the control signal.

Figures 12A, 12B, 12C:
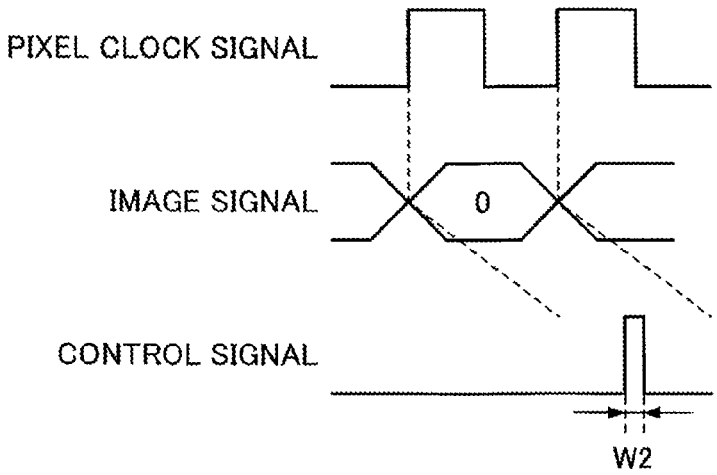
FIGS. 12A through 12C illustrate an example where a control signal according to a third embodiment is generated.

FIGS. 12A through 12C illustrate an example where the control signal according to a third embodiment is generated.

FIG. 12A is an example timing chart of the control signal according to the third embodiment. As illustrated in FIG. 12A, when the value of the image signal is 0, the PWM signal generation section 2121 generates the control signal having a time width W2 which is shorter than the light-emission delay.

In this case, the time width W2 of the control signal is determined based on a temperature of the light source LD or a temperature in the vicinity of (near) the light source LD.

To measure (detect) the temperature, a temperature sensor to detect the temperature of the light source LD or the temperature in the vicinity of (near) the light source LD is installed. The time width W2 of the control signal is calculated based on the measured temperature as shown in the following Formula 1-1.

$$W2=(\text{reference time width "}BT\text{"})\times(\text{correction coefficient "}WT\text{" of the temperature}) \quad \text{Formula 1-1}$$

Here, the correction coefficient "WT" is determined in accordance with a temperature set table 500 as illustrated in FIG. 12B. For example, when the reference time width "BT" is 1 ns and the temperature is 20° C., the time width "W2" is determined based on the following Formula 1-2.

$$W2=1\text{ ns}\times1.2=1.2\text{ ns} \quad \text{Formula 1-2}$$

Based on the above calculation result, the PWM signal generation section 2121 generates the control signal having a time width of 1.2 ns.

By generating the control signal having the time width that is determined based on the temperature by the PWM signal generation section 2121, it becomes possible to improve the responsiveness even when, for example, the characteristics of the light source LD is changed due to the temperature of the light source LD, it becomes possible to improve the responsiveness of the light source LD.

In the same manner, the time width "W2" of the control signal may be determined based on the voltage of the control signal. In the case where the time width "W2" of the control signal is determined based on the voltage of the control signal, the time width "W2" of the control signal is calculated based on the following Formula 2-1.

$$W2=(\text{reference time width "}BT\text{"})\times(\text{correction coefficient "}WV\text{" of the voltage of the control signal}) \quad \text{Formula 2-1}$$

For example, an amount of light in a range from 0 mW to 10 mW is to be controlled by using the control signal having a voltage in a range from 0 V to 2 V, the correction coefficient "WV" of the voltage of the control signal is determined based on a voltage set table 501 as illustrated in FIG. 12C. For example, when the reference time width "BT" is 1 ns and the voltage of the control signal is 0.5 V, the time width "W2" of the control signal is calculated based on the following Formula 2-2.

$$W2=1\text{ ns}\times1.2=1.2\text{ ns} \quad \text{Formula 2-2}$$

Based on the above calculation result, the PWM signal generation section 2121 generates the control signal having a time width of 1.2 ns.

By generating the control signal having the time width that is determined based on the voltage of the control signal by the PWM signal generation section 2121, it becomes possible to improve the responsiveness even when, for example, the voltage of the control signal is changed, it becomes possible to improve the responsiveness of the light source LD.

Further, the time width "W2" of the control signal may be determined based on both the temperature and the voltage of the control signal. In the case where the time width "W2" of the control signal is determined based on both the temperature and the voltage of the control signal, the time width "W2" of the control signal is calculated based on the following Formula 3-1.

$$W2=(\text{reference time width "}BT\text{"})\times(\text{correction coefficient "}WT\text{" of the temperature})\times(\text{correction coefficient "}WV\text{" of the voltage of the control signal}) \quad \text{Formula 3-1}$$

For example, when the reference time width "BT" is 1 ns, the temperature is 20° C., and the voltage of the control signal is 0.5 V, the time width "W2" of the control signal is calculated based on the following Formula 3-2.

$$W2=1\text{ ns}\times1.2\times1.2=1.44\text{ ns} \quad \text{Formula 3-2}$$

Based on the above calculation result, the PWM signal generation section 2121 generates the control signal having a time width of 1.44 ns.

By generating the control signal having the time width that is determined based on the temperature and the voltage of the control signal by the PWM signal generation section 2121, it becomes possible to improve the responsiveness of the light source LD even when, for example, the characteristics of the light source LD is changed due to the voltage of the control signal or the temperature of the light source.

signal may be adjusted by an instruction from the operation panel 2 by a user of the image forming apparatus or an operator such as a service person (hereinafter collectively referred to as an "operator"). By generating the control signal based on the operator's instruction, it becomes possible to correspond to, for example, secular change of the image forming apparatus.

Fourth Embodiment

Figure 13:
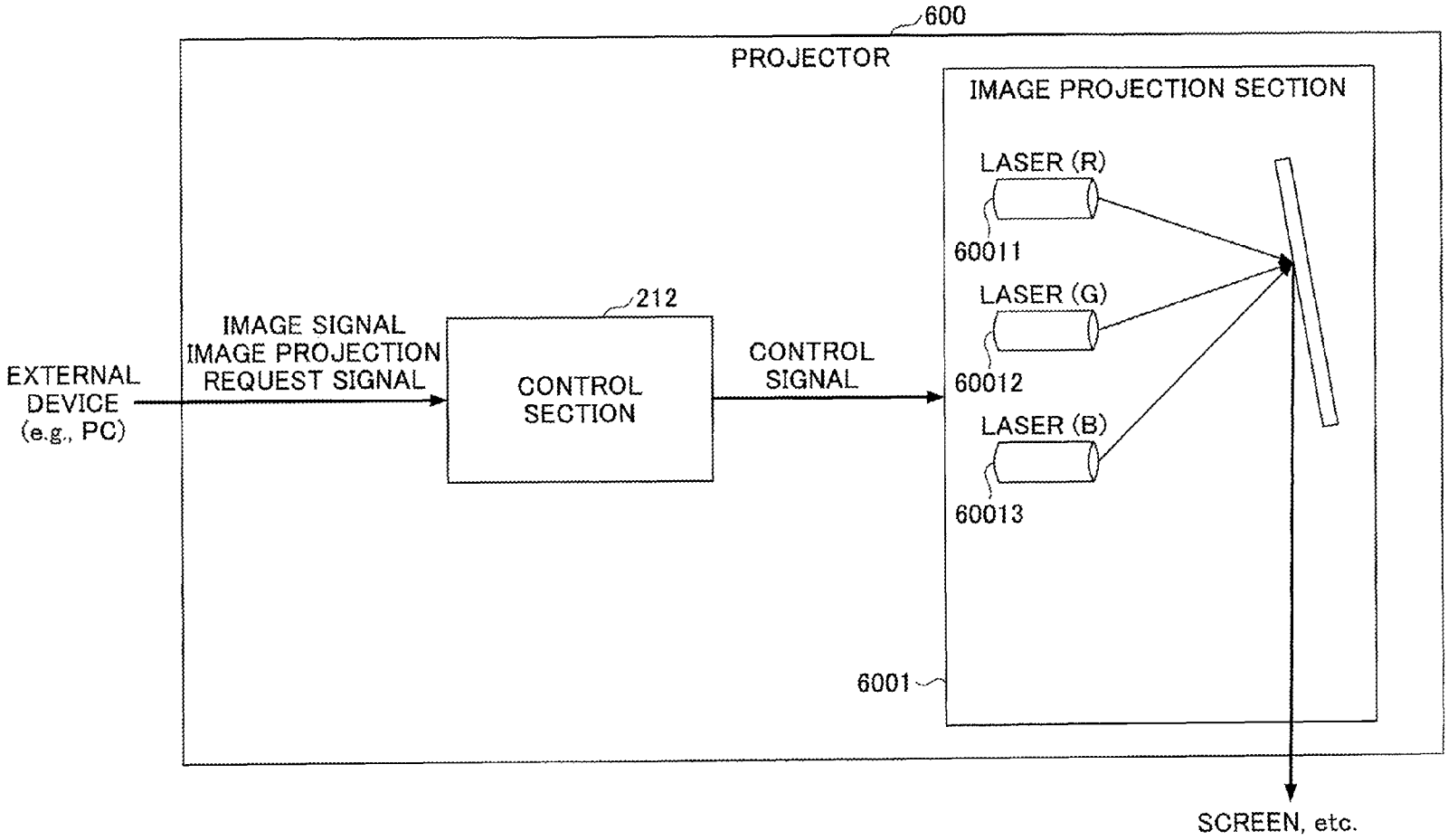
FIG. 13 is a functional block diagram of an example projecting device according to a fourth embodiment.

FIG. 13 is a functional block diagram of an example projecting device according to a fourth embodiment. In the fourth embodiment, an example is described where an optical scanning method according to an embodiment of the present invention is used in a projecting device. A projector 600 in FIG. 13 is an example of the projecting device.

The projector 600 includes an image projecting section 6001 and the control section 212.

The image projecting section 6001 includes lasers 60011, 60012, and 60013 which are the light sources of colors.

The control section 212 generates the control signal described above with reference to FIG. 7. The lasers 60011, 60012, and 60013 are turned on and off based on the control signal generated by the control section 212.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An optical scanning device comprising:

a light source configured to emit light to form an image by performing optical scanning a light emission delay after receiving a control signal, if the control signal is still in an ON state after the light emission delay; and a control section configured to generate the control signal based on an image signal such that a time width of the control signal is less than the light emission delay if the image signal is zero.

2. The optical scanning device according to claim 1, wherein the control section is configured to generate the control signal having the time width less than the light emission delay only in a time period other than a time period during the optical scanning in an area of the image.

3. The optical scanning device according to claim 1, wherein the control section is configured to determine the time width based on a temperature of the light source or a temperature near the light source.

4. The optical scanning device according to claim 1, wherein the control section is configured to determine the time width based on a voltage of the control signal.

5. The optical scanning device according to claim 1, wherein the control section is configured to determine the time width based on an instruction from an operator.

6. The optical scanning device according to claim 1, wherein the light emission delay is a time period from when the control signal instructs the light source to turn on to when the light source generates light.

7. An image forming apparatus comprising:

the optical scanning device according to claim 1.

8. An optical scanning method of scanning with light from a light source to form an image, the method comprising:

generating a control signal based on an image signal such that a time width of the control signal is less than a light emission delay if the image signal is zero, and scanning by emitting light a light emission delay after receiving the control signal, if the control signal is still in an ON state after the light emission delay.

9. A device for scanning with light from a light source to form an image, comprising:

means for generating a control signal based on an image signal such that a time width of the control signal is less than a light emission delay if the image signal is zero, and means for scanning by emitting light a light emission delay after receiving the control signal, if the control signal is still in an ON state after the light emission delay.

* * * * *